US010596718B2

(12) United States Patent
Yang

(10) Patent No.: US 10,596,718 B2
(45) Date of Patent: Mar. 24, 2020

(54) HANDHELD MORTISE FORMING DEVICE

(71) Applicant: Jack Yang, Taichung (TW)

(72) Inventor: Jack Yang, Taichung (TW)

( * ) Notice: Subject to any disclaimer, the term of this patent is extended or adjusted under 35 U.S.C. 154(b) by 385 days.

(21) Appl. No.: 15/429,253

(22) Filed: Feb. 10, 2017

(65) Prior Publication Data

US 2018/0147741 A1 May 31, 2018

(30) Foreign Application Priority Data

Nov. 28, 2016 (TW) ..... 105139130 A

(51) Int. Cl.

| | |
|---|---|
| ***B27F 5/02*** | (2006.01) |
| ***B27F 1/12*** | (2006.01) |
| ***B27F 1/00*** | (2006.01) |
| ***B27F 1/02*** | (2006.01) |

(52) U.S. Cl.

CPC ..... *B27F 5/023* (2013.01); *B27F 1/00* (2013.01); *B27F 1/02* (2013.01); *B27F 1/12* (2013.01); *B27F 5/02* (2013.01)

(58) Field of Classification Search

CPC ..... B27F 1/00; B27F 1/02; B27F 1/04; B27F 1/08; B27F 1/12; B27F 1/16; B27F 5/00; B27F 5/02

See application file for complete search history.

(56) References Cited

U.S. PATENT DOCUMENTS 4,809,755 A * 3/1989 Pontikas ..... B27F 1/12 144/144.51
8,113,429 B2 * 2/2012 Craig ..... G06K 7/109 235/462.32

FOREIGN PATENT DOCUMENTS

TW I411506 B 10/2013

* cited by examiner

*Primary Examiner* — Matthew Katcoff
(74) *Attorney, Agent, or Firm* — Alan D. Kamrath; Karin L. Williams; Mayer & Williams PC

(57) ABSTRACT

A handheld mortise forming device includes a base unit having a first support extending parallel to a first axis. The first support includes first and second working ends. A first sidewall and a second sidewall are connected to the first support. One of two connecting units is rotatably mounted to the first sidewall. The other connecting unit is rotatably mounted to the second sidewall. A second support extends parallel to the first axis and is connected to the two connecting units. The second support is rotatable relative to the first and second sidewalls and includes an abutting face. A clamping unit includes a pressing member located on a side of the second support adjacent to the abutting face. The pressing member can clamp lumber. The pressing member is jointly rotatable with the second support and is switchable between the first working end and the second working end.

6 Claims, 13 Drawing Sheets

HANDHELD MORTISE FORMING DEVICE

BACKGROUND OF THE INVENTION

The present invention relates to a handheld mortise forming device and, more particularly, to a handheld mortise forming device that can be adjusted according to the design needs of the user.

Taiwan Invention Patent No. 1411506 discloses a mortise forming machine with a traction movement device. The mortise forming machine includes a frame having two sidewalls and a guiding board extending between top ends of the two sidewalls. The guiding board has a plurality of grooves spaced from each other by regular intervals. A workpiece stands upright on the guiding board. The grooves are used to form a mortise in the workpiece by milling. First and second clamping devices are disposed on the frame. The first clamping device includes a vertical abutment plate fixed to a top end of the frame. The abutment plate abuts a side of the workpiece. Two clamping members are disposed on two sides of the workpiece to clamp the workpiece. A pressing rod is disposed on the other side of the workpiece opposite to the abutment plate. A lever is disposed on one of the two sidewalls to control eccentric rotation of the pressing rod for pressing against the workpiece. The second holding device is substantially the same as the first holding device and is used to position the workpiece placed horizontally on the guiding board. A guiding track is disposed on an end of the frame opposite to the guiding board. Two guiding rods are respectively disposed on two sides of the guiding track. The workpiece can only stand upright on the guiding board of the frame, such that only a type of mortise can be formed in the workpiece by milling.

Thus, a need exists for a novel mortise forming device that mitigates and/or obviates the above disadvantage.

BRIEF SUMMARY OF THE INVENTION

A handheld mortise forming device according to the present invention includes a base unit having a first support extending parallel to a first axis. The first support includes a first working end and a second working end opposite to the first working end. A first sidewall and a second sidewall are connected to the first support. One of two connecting units is rotatably mounted to the first sidewall. The other connecting unit is rotatably mounted to the second sidewall. A second support extends parallel to the first axis and is connected to the two connecting units. The second support is rotatable relative to the first and second sidewalls and includes an abutting face. A clamping unit includes a pressing member located on a side of the second support adjacent to the abutting face. The pressing member is adapted to clamp lumber. The pressing member is jointly rotatable with the second support and is switchable between the first working end and the second working end.

In an example, the first and second working ends are located on two opposite ends of the first support along a second axis perpendicular to the first axis. The first sidewall includes a first sliding track extending parallel to the second axis. The second sidewall includes a second sliding track extending parallel to the first sliding track. One of the two connecting units is rotatably and slideably received in the first sliding track. The other connecting unit is rotatably and slideably received in the second sliding track. The second support is slideably connected to the two connecting units to thereby move toward or away from the first support. The second support is slideable between the first working end and the second working end. The clamping unit further includes a clamping member disposed between the first and second working ends of the first support. The clamping member is adapted to clamp the lumber.

In an example, the first sliding track extends through two opposite surfaces of the first sidewall. The second sliding track extends through two opposite surfaces of the second sidewall. Each of the two connecting units includes a sliding member and at least one pin. The sliding member includes a base portion and at least one through-hole extending through the base portion. The base portion of one of the two connecting units is located on a side of the sliding member adjacent to the first sidewall. The base portion of the other connecting unit is located on a side of the sliding member adjacent to the second sidewall. The at least one pin of one of the two connecting units removably extends through the first sliding track and removably extends through the at least one through-hole of the one of the two connecting units. The at least one pin of the other connecting unit removably extends through the second sliding track and removably extends through the at least one through-hole of the other connecting unit.

In an example, each sliding member includes a first extension disposed on the base portion thereof and extending toward the second support. The first extension includes a sliding slot extending through two opposite surfaces of the first extension and extending parallel to the base portion. The second support includes a fixing groove in a face thereof opposite to the abutting face. Each of the two connecting units includes a fixing member removably mounted in the fixing groove of the second support and removably and slideably extending through the sliding slot of one of the sliding members.

In an example, each sliding member includes a second extension connected to the base portion and extending parallel to the first extension. The second support slideably extends between the first and second extensions of each sliding member. The at least one through-hole of each of the two connecting units includes six through-holes. Two of the six through-holes are located on a side of the first extension distant to the second extension. Another two of the six through-holes are located between the first and second extensions. The remaining two through-holes are located on a side of the second extension distant to the first extension. The at least one pin of each of the two connecting units includes two pins respectively extending two of the six through-holes.

In an example, each of the two pins of each of the two connecting units includes a thread. The threads of the two pins of one of the two connecting units are located on a side of the first sidewall distant to the second support. The threads of the two pins of the other of the two connecting units are located on a side of the second sidewall distant to the second support. The fixing member of each of the two connecting units includes a thread located on a side of the first extension distant to the second support. Each of the two connecting units further includes a first nut, a second nut, and a third nut. The first and second nuts are threadedly engaged with the threads of the two pins. The third nut is threadedly engaged with the thread of the fixing member.

In an example, the first support includes a first groove between the first and second working ends. The second support includes a second groove on a side of the second support adjacent to the abutting face. The clamping unit includes a first bolt, a first thumb turn, a first pressing block, a second bolt, a second thumb turn, and a second pressing block. The first bolt and the first pressing block are slideably received in the first groove. The first bolt extends through the clamping member. The first thumb turn is threadedly engaged with the first bolt and presses against the clamping member to clamp the lumber. The first pressing block presses against the lumber. The second bolt and the second pressing block are slideably received in the second groove. The second bolt extends through the pressing member. The second thumb turn is threadedly engaged with the second bolt and presses against the pressing member to clamp the lumber. The second pressing block presses against the lumber.

In an example, the first sidewall includes a first gripping portion and a first connecting end. The first sliding track is located between the first gripping portion and the first connecting end. The second sidewall includes a second gripping portion and a second connecting end. The second sliding track is located between the second gripping portion and the second connecting end. The first and second gripping portions are adapted to be gripped by a user.

In an example, the first sidewall further includes a first sliding slot adjacent to the first working end of the first support. The second sidewall includes a second sliding slot adjacent to the first working end of the first support. The base unit includes an abutting member, a first screw, a second screw, a first fastener, and a second fastener. The abutting member extends toward the first and second sidewalls and is located on a side of the first working end distant to the second support. The first screw extends through the abutting member and is slideably received in the first sliding slot of the first sidewall. The second screw extends through the abutting member and is slideably received in the second sliding slot of the second sidewall. The first fastener is threadedly engaged with the first screw. The second fastener is threadedly engaged with the second screw. The abutting member is positioned relative to the first working end.

The present invention will become clearer in light of the following detailed description of illustrative embodiments of this invention described in connection with the drawings.

DETAILED DESCRIPTION OF THE INVENTION

Figure 1:
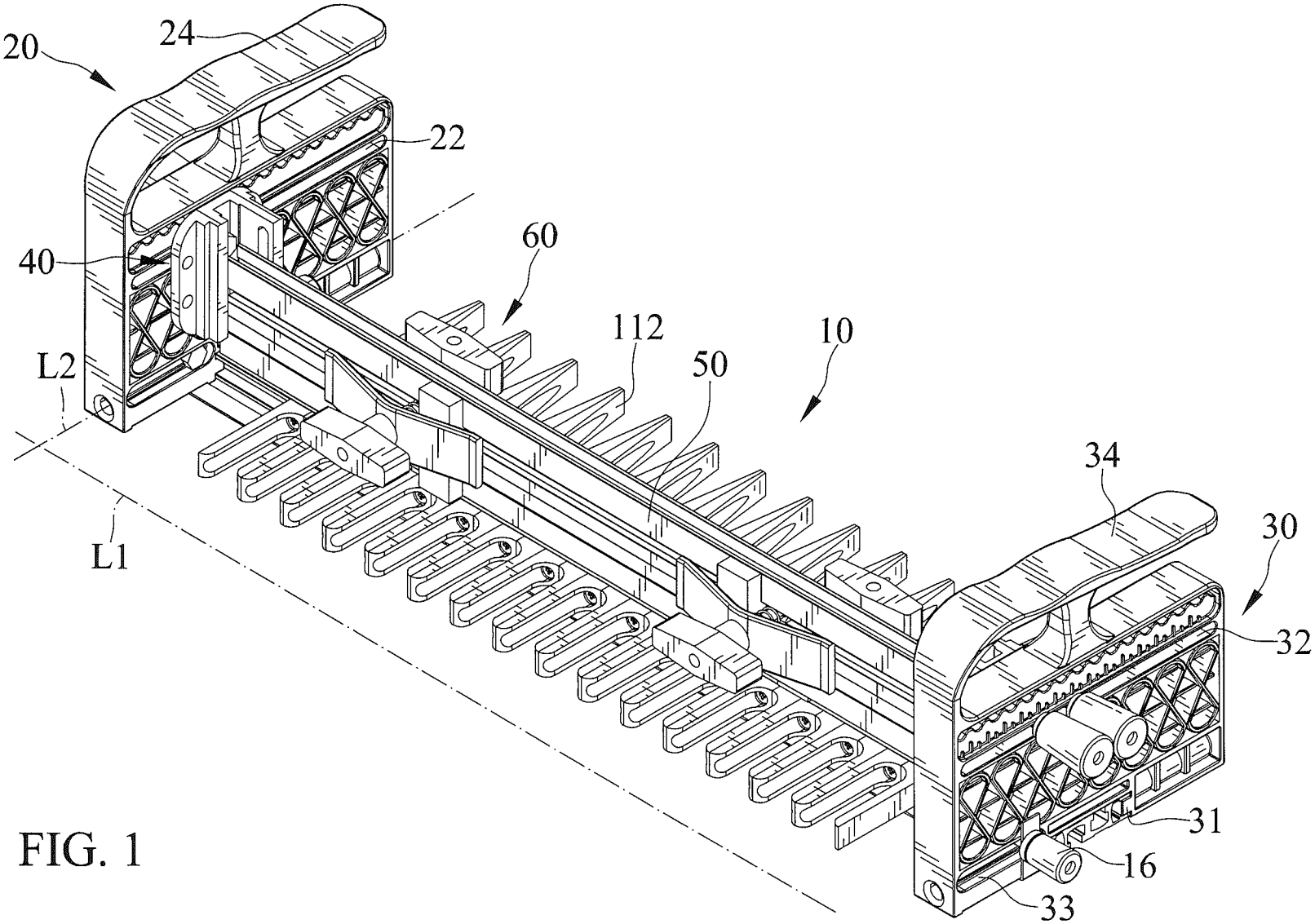
FIG. 1 is a perspective view of a handheld mortise forming device according to the present invention, with a second support located adjacent to a first working end of a first support.

With reference to FIGS. 1-5, a handheld mortise forming device according to the present invention includes a base unit 10, a first sidewall 20, a second sidewall 30, two connecting units 40, a second support 50, and a clamping unit 60. The first sidewall 20 and the second sidewall 30 are located on two opposite sides of the base unit 10. One of the two connecting units 40 is rotatably and slideably mounted to the first sidewall 20. The other connecting unit 40 is rotatably and slideably mounted to the second sidewall 30. The second support 50 is slideably connected to the two connecting units 40 and is located between the two connecting units 40. The clamping unit 60 is mounted to the base unit 10 and the second support 50 for clamping lumber.

The base unit 10 can be placed on a working table and includes a first support 11 extending parallel to a first axis L1 and having a first working end 111, a second working end 112, a first groove 113, and a placement face 114. The first working end 111 and the second working end 112 are located on two opposite ends of the first support 11 along a second axis L2 perpendicular to the first axis L1. The first groove 113 and the placement face 114 are located between the first and second working ends 111 and 112 and extend parallel to the first axis L1. The lumber can be placed on the placement face 114. In this embodiment, the first working end 111 includes a plurality of U-shaped grooves disposed along the first support 11, and the second working end 112 includes a plurality of V-shaped grooves disposed along the first support 11. A triangular cutter mounted on the working table can enter the U-shaped grooves of the first working end 111 to cut dovetail grooves in the lumber clamped by the handheld mortise forming device. A vertical cutter mounted on the working table can enter the V-shaped grooves of the second working end 112 to cut vertical grooves in the lumber clamped by the handheld mortise forming device.

The first sidewall 20 includes a first end 201, a second end 202, a first connecting end 21, a first sliding track 22, a first sliding slot 23, and a first gripping portion 24. The first end 201 and the second end 202 are located on two opposite ends of the first sidewall 20 along the second axis L2. The first connecting end 21 is connected to the first support 11. The first sliding track 22 is formed in the first sidewall 20 and extends parallel to the second axis L2. The first sliding groove 22 extends through two opposite faces of the first sidewall 20. The first sliding slot 23 extends through two opposite faces of an end of the first sidewall 20 adjacent to the first working end 111 of the first support 11. One of the two connecting units 40 is rotatably and slideably received in the first sliding track 22 located between the first gripping portion 24 and the first connecting end 21.

The second sidewall 30 includes a second connecting end 31, a second sliding track 32, a second sliding slot 33, and a second gripping portion 34. The second connecting end 31 is connected to an end of the first support 11 distant to the first sidewall 20. The second sliding track 32 is formed in the second sidewall 30 and extends parallel to the first sliding track 22. The second sliding track 32 extends through two opposite surfaces of the second sidewall 30. The second sliding slot 33 extends through two opposite surfaces of an end of the second sidewall 30 adjacent to the first working end 111 of the first support 11. The other connecting unit 40 is rotatably and slideably received in the second sliding track 32 located between the second gripping portion 34 and the second connecting end 31. The user can grip the first and second gripping portions 24 and 34 to move the handheld mortise forming device relative to the working table.

In this embodiment, the base unit 10 further includes an abutting member 12, a first screw 13, a second screw 14, a first fastener 15, and a second fastener 16. The abutting member 12 extends toward the first and second sidewalls 20 and 30 and is located on a side of the first working end 111 distant to the second support 50. The first screw 13 extends through the abutting member 12 and is slideably received in the first sliding slot 23 of the first sidewall 20. The second screw 14 extends through the abutting member 12 and is slideably received in the second sliding slot 33 of the second sidewall 30. The first fastener 15 is threadedly engaged with the first screw 13. The second fastener 16 is threadedly engaged with the second screw 14. Thus, the abutting member 12 can be positioned relative to the first working end 111.

Each of the two connecting units 40 includes a sliding member 41, at least one pin 42, and a fixing member 43. The at least one pin 42 of one of the two connecting units 40 removably extends through the first sliding track 22 and removably extends through the sliding member 41 of the connecting unit 40. The at least one pin 42 of the other connecting unit 40 removably extends through the second sliding track 32 and removably extends through the sliding member 41 of the other connecting unit 40. Thus, one of the two sliding members 41 is slideable relative to the first sidewall 20 and is rotatable relative to the first sidewall 20. The other sliding member 41 is slideable relative to the second sidewall 30 and is rotatable relative to the second sidewall 30. The fixing member 43 is removably mounted in the second support 50 and removably and slideably extends through the sliding member 41.

In this embodiment, each of the two connecting units 40 further includes a first nut 44, a second nut 45, and a third nut 46. The first and second nuts 44 and 45 are threadedly engaged with the two pins 42. The third nut 46 is threadedly engaged with the fixing member 43.

The sliding member 41 includes a base portion 411, at least one through-hole 412, a first extension 413, and a second extension 414. The base portion 411 of one of the two connecting units 40 is located on a side of the sliding member 41 adjacent to the first sidewall 20. The base portion 411 of the other connecting unit 40 is located on a side of the sliding member 41 adjacent to the second sidewall 30. The at least one through-hole 412 extends through the base portion 411. The at least one pin 42 extends through the at least one through-hole 412. The first extension 413 is disposed on the base portion 411 and extends toward the second support 50. The second extension 414 is connected to the base portion 414 and extends parallel to the first extension 413. The second support 50 slideably extends between the first and second extensions 413 and 414. In this embodiment, each connecting unit 40 includes six through-holes 412. Two of the six through-holes 412 are located on a side of the first extension 413 distant to the second extension 414. Another two of the six through-holes 412 are located between the first and second extensions 413 and 414. The remaining two through-holes 412 are located on a side of the second extension 414 distant to the first extension 413. Each connecting unit 40 includes two pins 42 respectively and removably extending two of the six through-holes 412. Thus, the user can extend the two pins 42 through two of the six through-holes 412 according to need.

The base portion 411 includes a first surface 4111 and a second surface 4112 opposite to the first surface 4111. Two opposite surfaces of the first extension 413 respectively extend toward the first and second surfaces 4111 and 4112. Two opposite surfaces of the second extension 414 respectively extend toward the first and second surfaces 4111 and 4112. Three of the six through-holes 412 are located on a side of the base portion 411 adjacent to the first surface 4111. The remaining three through-holes 412 are located on a side of the base portion 411 adjacent to the second surface 4112. In this embodiment, the user can extend the two pins 42 through two of the three through-holes 412 adjacent to the first surface 4111, such that the second support 50 is perpendicular to the first support 11.

The first extension 413 includes a sliding slot 4131 extending through the two opposite surfaces of the first extension 413 and extends parallel to the base portion 411. The fixing member 43 removably and slideably extends through the sliding slot 4131. Each of the two pins 42 of each connecting unit 40 includes a thread 421. The threads 421 of the two pins 42 of one of the two connecting units 40 are located on a side of the first sidewall 20 distant to the second support 50. The threads 421 of the two pins 42 of the other connecting unit 40 are located on a side of the second sidewall 30 distant to the second support 50. The first and second nuts 44 and 45 are respectively and threadedly engaged with the threads 421 of the two pins 42. The fixing member 43 of each connecting unit 40 includes a thread 431 located on a side of the first extension 413 distant to the second support 50. The third nut 46 is threadedly engaged with the thread 431 of the fixing member 43.

The second support 50 extends parallel to the first axis L1 and includes a fixing groove 51, a second groove 52, and an abutting face 53. The fixing groove 51 and the second groove 52 are respectively formed in two opposite surfaces of the second support 50 and respectively extend toward the first and second sidewalls 20 and 30. The fixing members 43 of the two connecting units 40 are removably mounted on two opposite sides of the fixing groove 51. The abutting face 53 is disposed on a side of the second support 50 adjacent to the second groove 52 and extends along a third axis L3 (see FIG. 9). The lumber can be placed on the abutting face 53.

The clamping unit 60 includes a clamping member 61, a first bolt 62, a first thumb turn 63, a first pressing block 64, a second bolt 66, a second thumb turn 67, and a second pressing block 68. The first bolt 62 and the first pressing block 64 are slideably received in the first groove 113. The first bolt 62 extends through the clamping member 61. The first thumb turn 63 is threadedly engaged with the first bolt 62 and presses against the clamping member 61 to clamp the lumber. The first pressing block 64 can press against the lumber. The second bolt 66 and the second pressing block 68 are slideably received in the second groove 52. The second bolt 66 extends through the pressing member 65. The second thumb turn 67 is threadedly engaged with the second bolt 66 and presses against the pressing member 65 to clamp the lumber. The second pressing block 68 can press against the lumber.

In this embodiment, the number of each of the clamping member 61, the first bolt 62, the first thumb turn 63, the first pressing block 64, the second bolt 66, the second thumb turn 67, and the second pressing block 68 is two. The two clamping members 61 together clamp the lumber. The two first pressing blocks 64 respectively press against two opposite sides of the lumber. The two pressing members 65 together clamp the lumber. The two second pressing blocks 68 respectively press against two opposite sides of the lumber.

Figure 3:
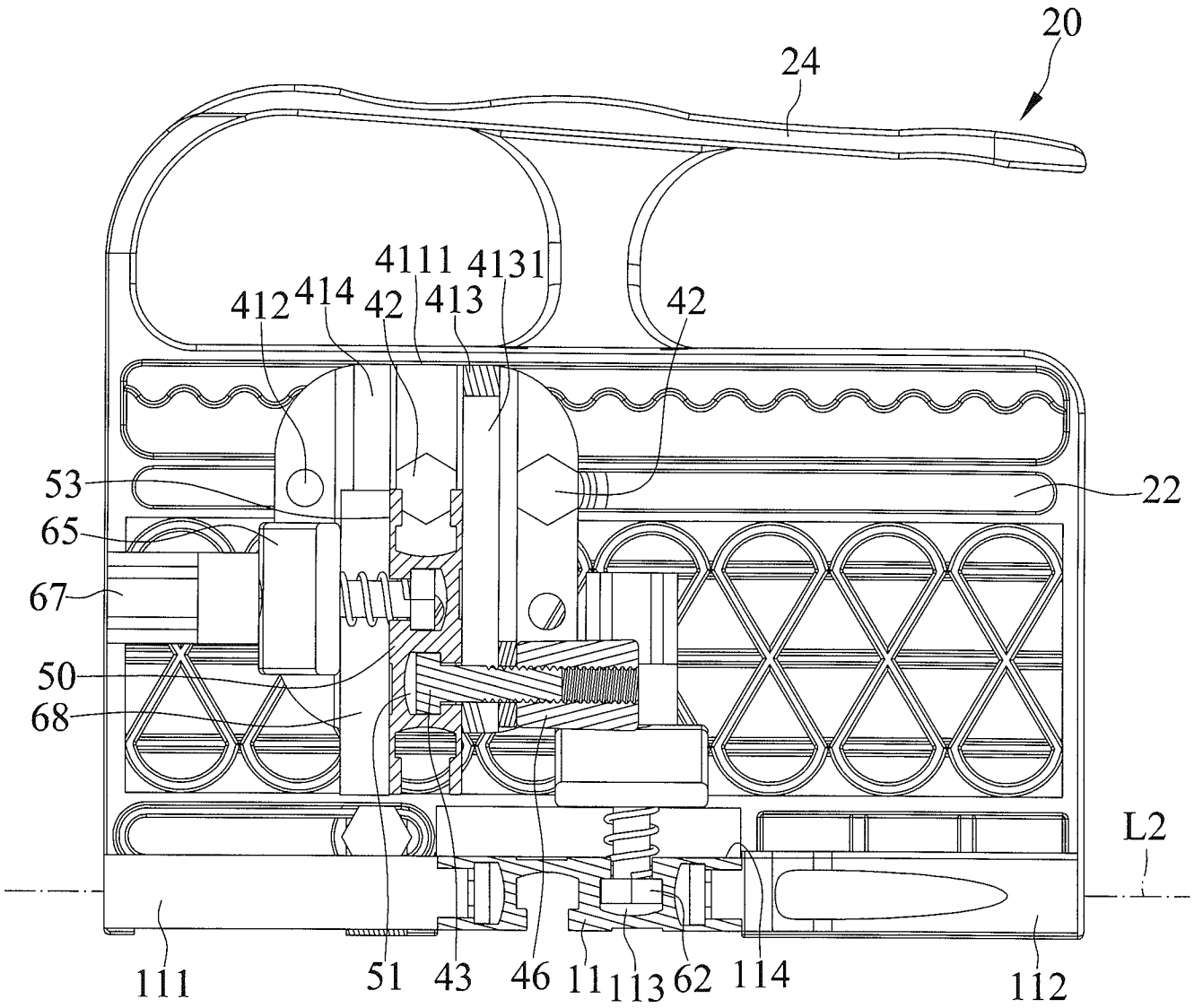
FIG. 3 is a cross sectional view the handheld mortise forming device of FIG. 1.
Figure 4:
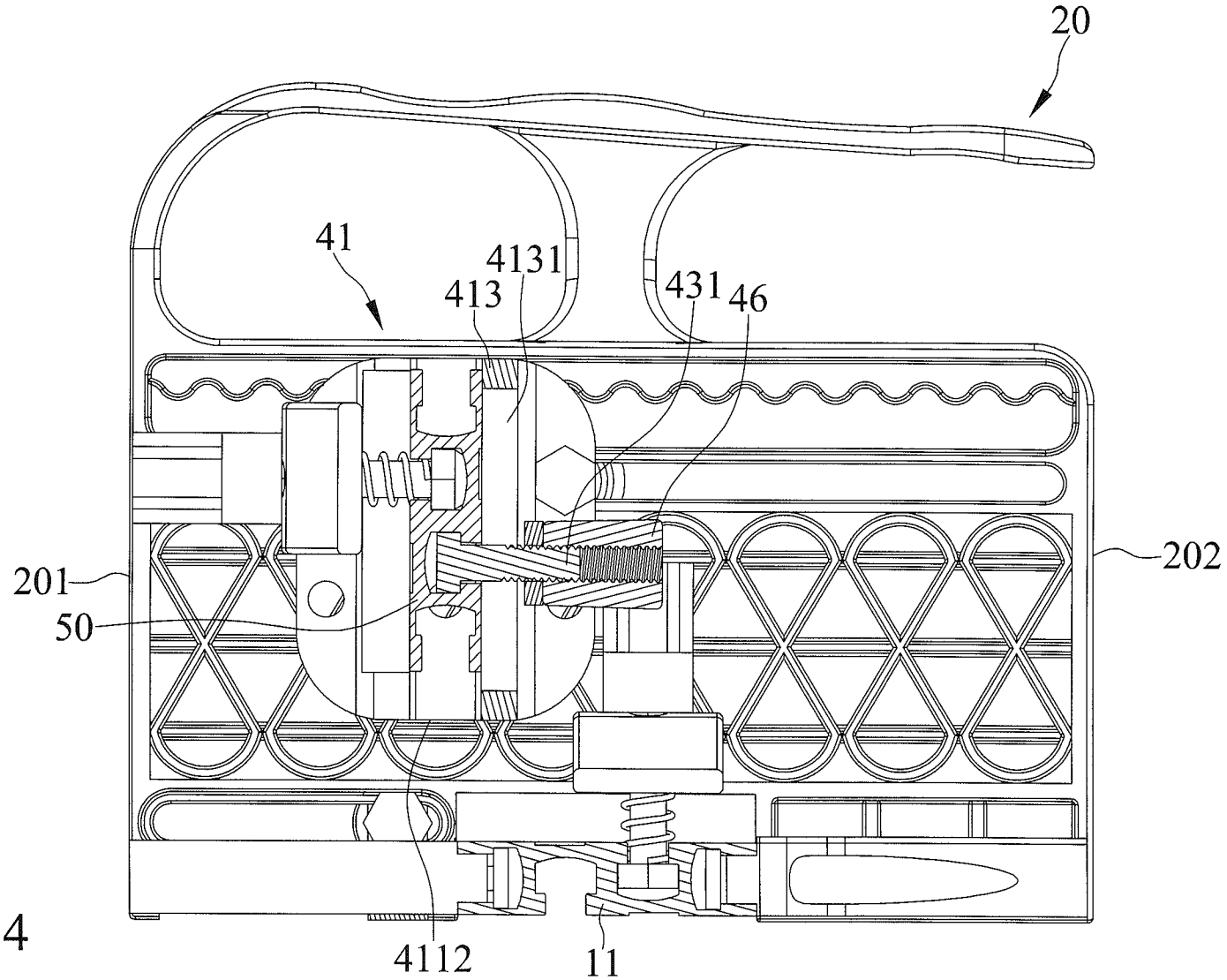
FIG. 4 is a view similar to FIG. 3 with the second support moved upward away from the first support.

With reference to FIGS. 3 and 4, when it is desired to move the second support 50 upward or downward relative to the first support 11, the third nut 46 is loosened first and is rotated relative to the thread 431 of the fixing member 43 in a direction away from the first extension 413. The fixing member 43 is slideable relative to the sliding slot 4131 of the sliding member 41. Then, the user moves the second support 50 to a desired height. Finally, the third nut 46 is rotated in a direction toward the first extension 413. The second support 50 and the third nut 46 together clamp the first extension 413 to thereby position the second support 50 in the desired height. Operations of the two connecting units 40 are identical. Thus, only the connecting unit 40 adjacent to the first sidewall 20 is set forth.

Figure 5:
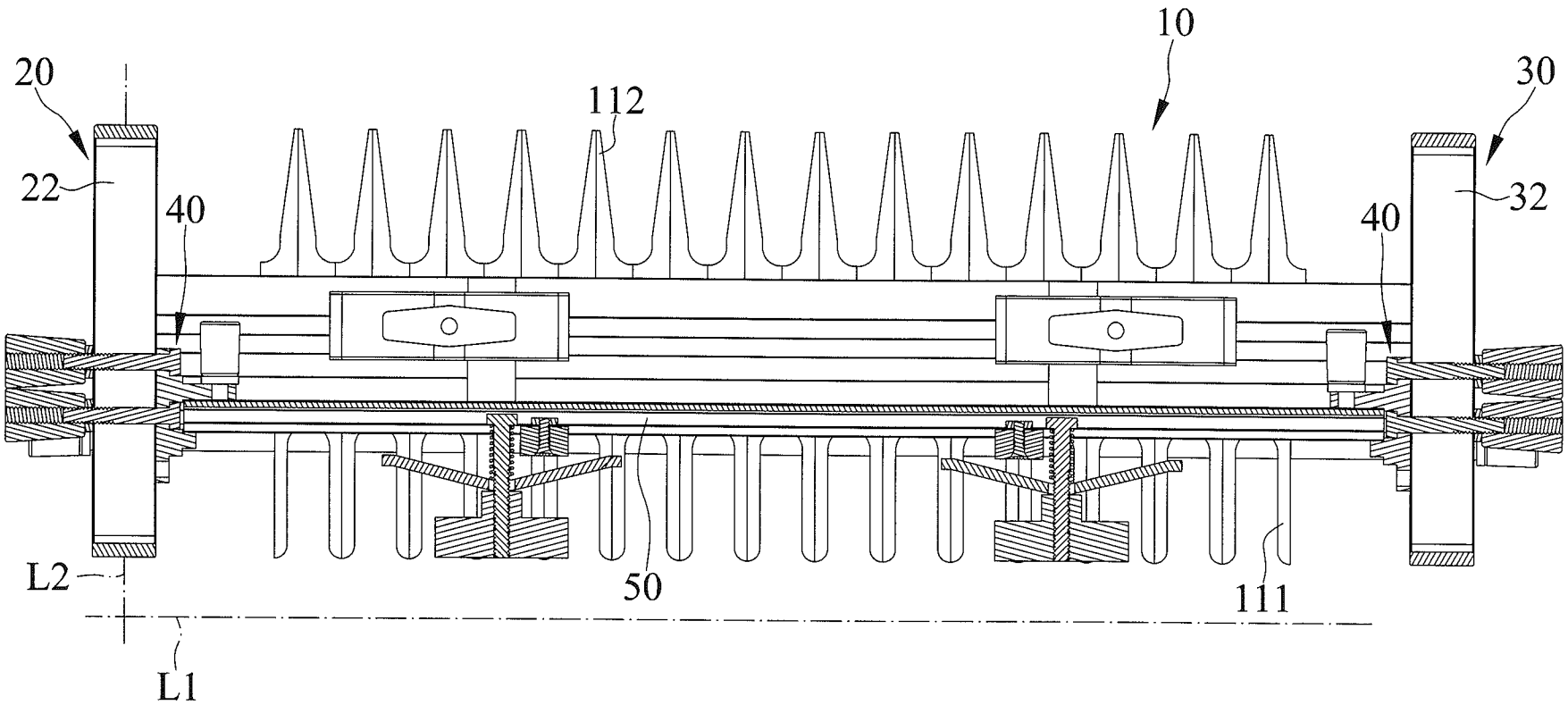
FIG. 5 is another cross sectional view of the handheld mortise forming device of FIG. 1.
Figure 6:
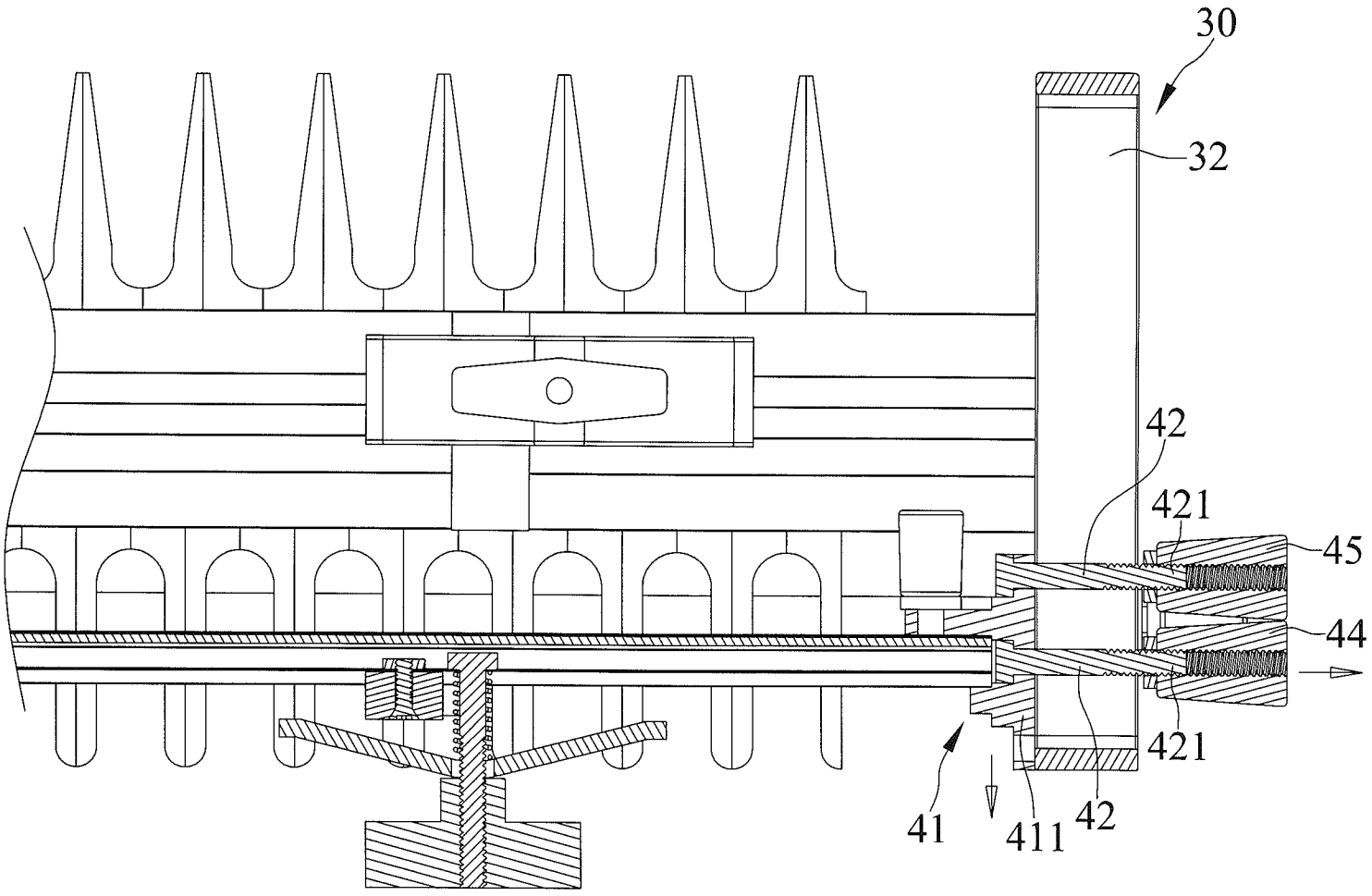
FIG. 6 is an enlarged view of a portion of FIG. 5, illustrating sliding movement of a connecting unit relative to a second sidewall.

With reference to FIGS. 5 and 6, when it is desired to move the second support 50 in a direction parallel to the first axis L1, the first and second nuts 44 and 45 are loosened first. The first nut 44 is rotated relative to the thread 421 of one of the two pins 42. The second nut 45 is rotated relative to the thread 421 of the other pin 42. The first and second nuts 44 and 45 are moved away from the second sidewall 30, such that the first and second nuts 44 and 45 of one of the two connecting units 40 slide relative to the second sliding track 32 of the second sidewall 30. Next, the user moves the second support 50 to a specific position. Finally, the first and second nuts 44 and 45 are rotated and moved toward the second sidewall 30, such that the first and second nuts 44 and 45 and the base portion 411 of the sliding member 41 together clamp the second sidewall 30 to position the second support 50 in the specific position. Operations of the two connecting units 40 are identical. Thus, only the connecting unit 40 adjacent to the second sidewall 30 is set forth.

Figure 7:
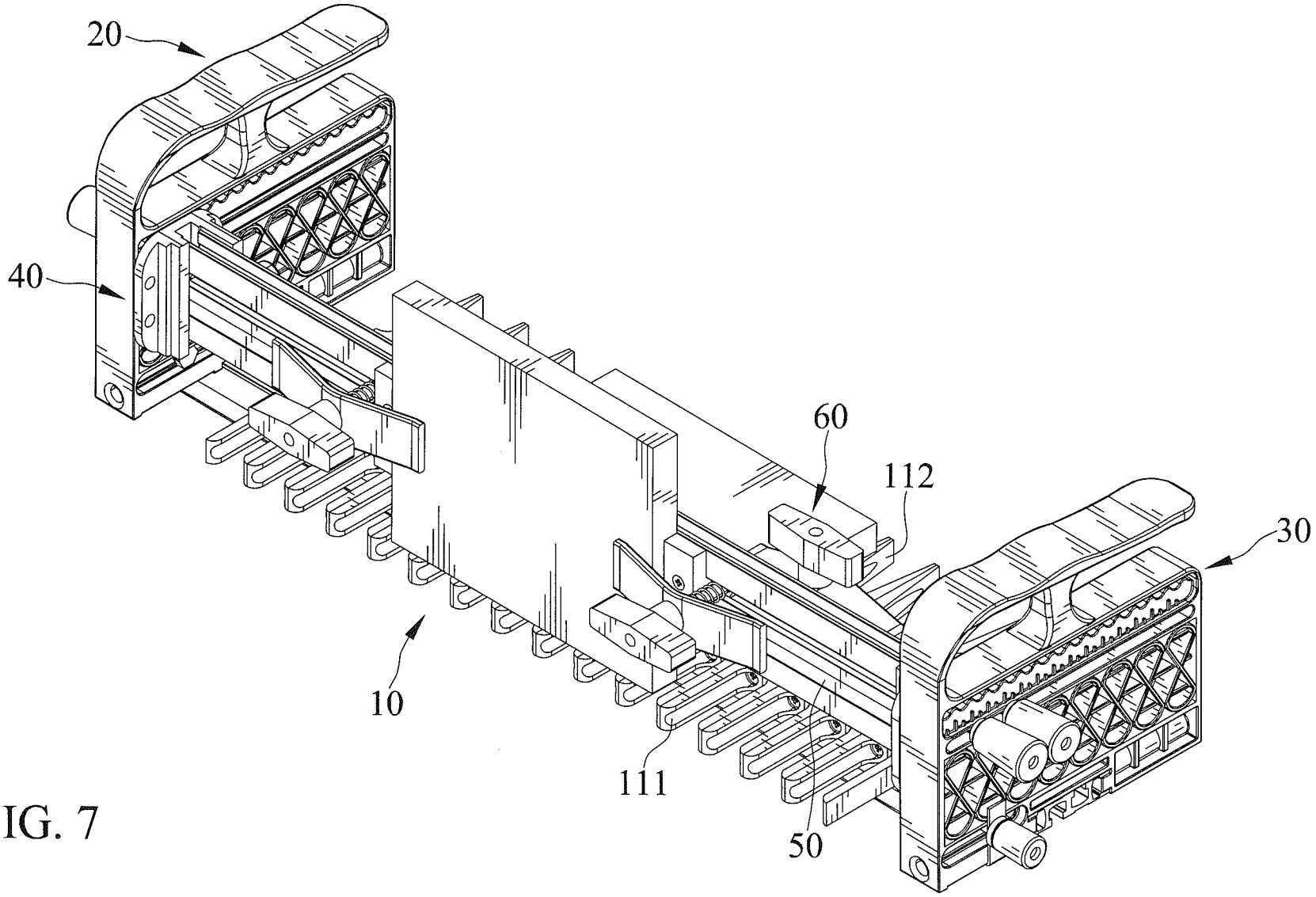
FIG. 7 is a perspective view illustrating use of the handheld mortise forming device according to the present invention, with a workpiece clamped by the first and second supports.
Figure 8:
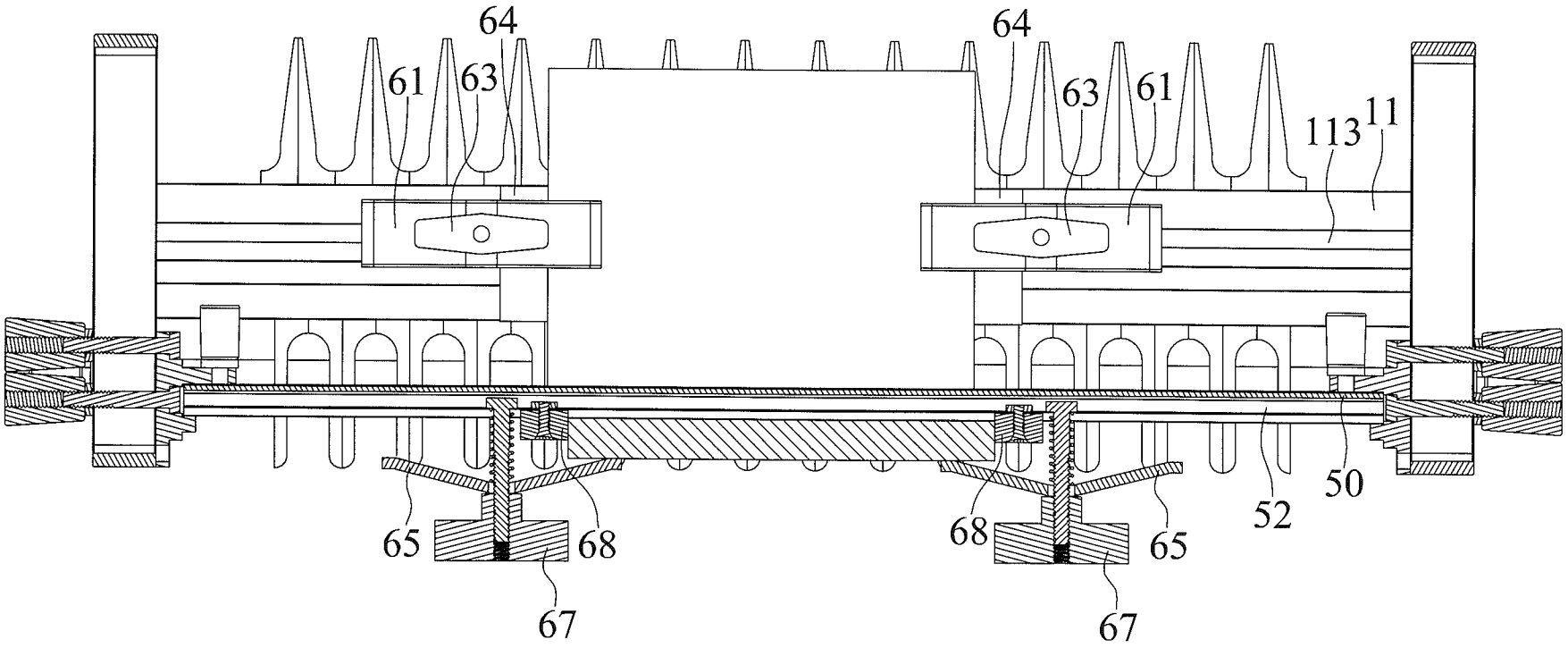
FIG. 8 is a cross sectional view of the handheld mortise forming device of FIG. 7.

With reference to FIGS. 7 and 8, when it is desired to clamp the lumber to the first support 11, the lumber is firstly placed on a side of the first support 11 adjacent to the second support 50. Then, the two first pressing blocks 64 are moved to slide relative to the first groove 113 of the first support 11 to press against two opposite sides of the lumber. Finally, the two first thumb turns 63 are rotated to move the two clamping members 61 toward the first support 11 to thereby clamp the lumber. When it is desired to clamp the lumber to the second support 50, the lumber is placed to abut a side of the second support 50 adjacent to the second groove 52. Then, the two second pressing blocks 68 are moved to slide relative to the second groove 52 of the second support 50 to press against two opposite sides of the lumber. Finally, the two second thumb turns 67 are rotated to move the two second pressing members 65 toward the second support 50 to thereby clamp the lumber.

Figure 2:
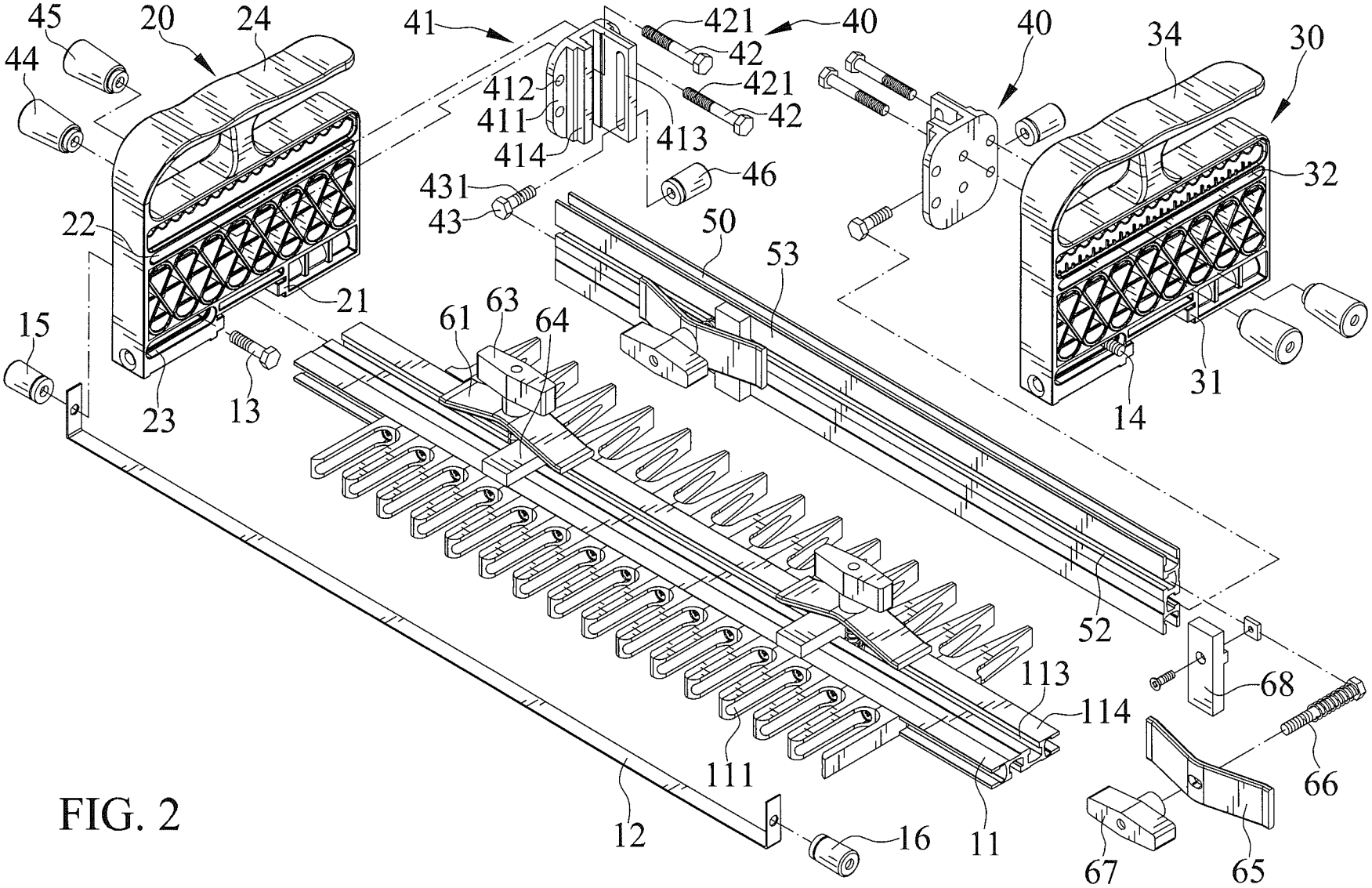
FIG. 2 is an exploded, perspective view of the handheld mortise forming device according to the present invention.
Figure 9:
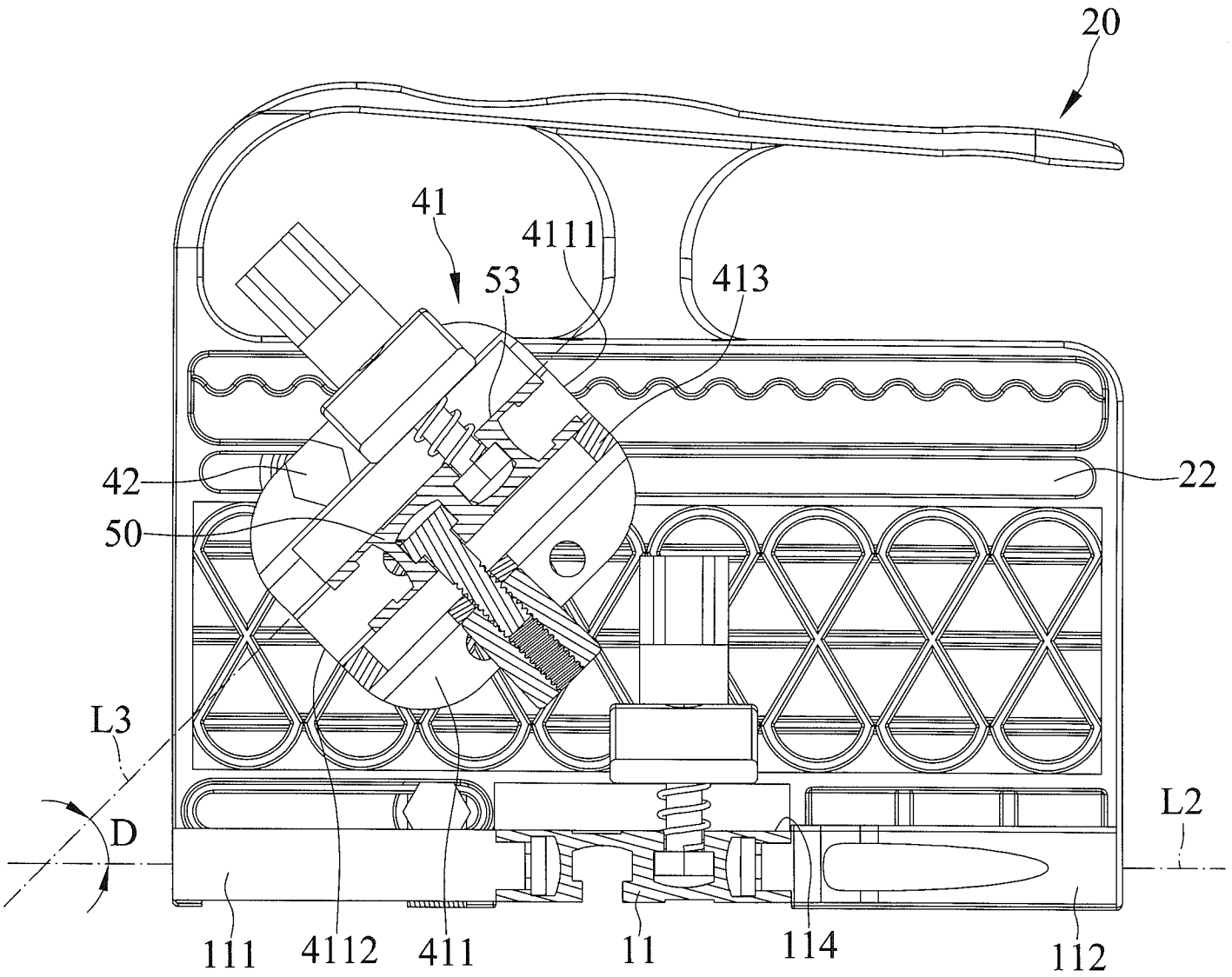
FIG. 9 is a diagrammatic view similar to FIG. 4, illustrating an angle between a second axis and a third axis during use of the handheld mortise forming device.
Figure 10:
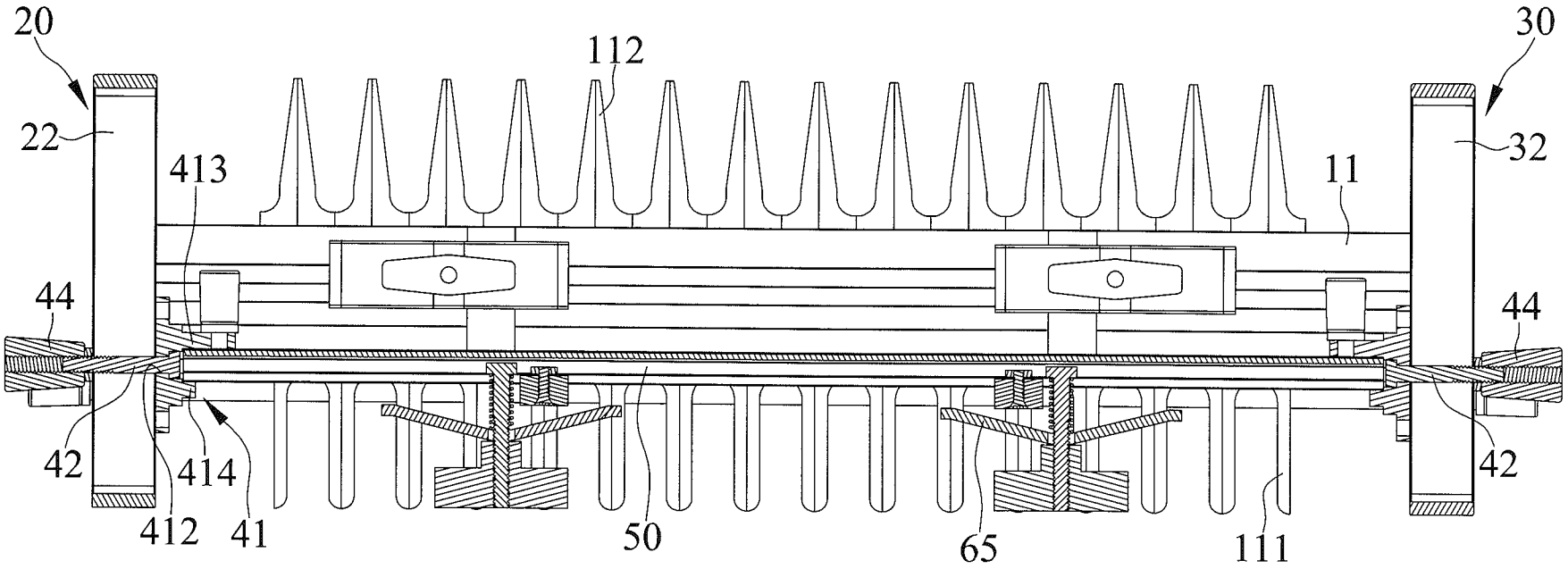
FIG. 10 is a diagrammatic view similar to FIG. 8, with a pin of one of two connecting units extending through a first sliding track and with a pin of the other connecting unit extending through a second sliding track.
Figure 11:
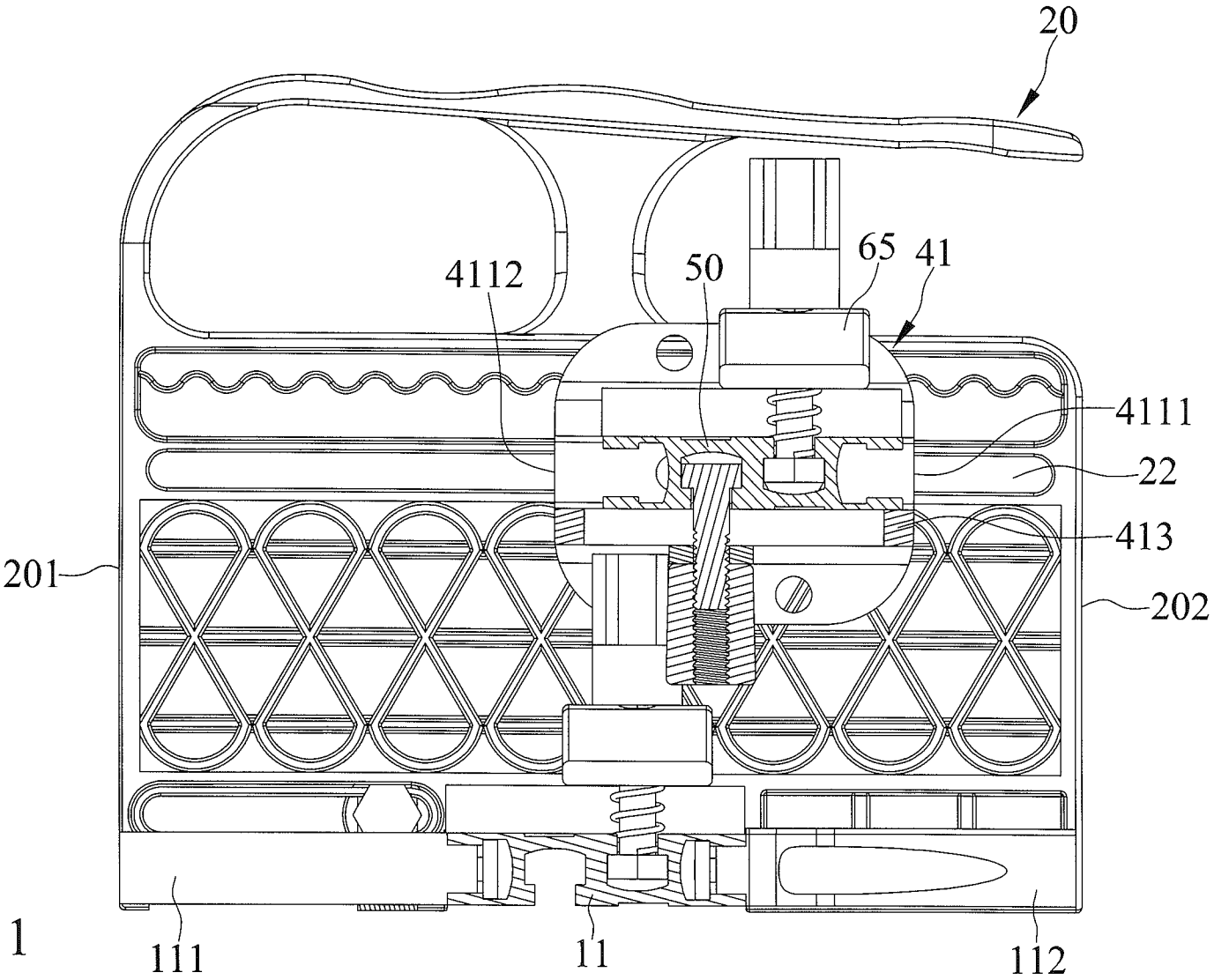
FIG. 11 is a diagrammatic view similar to FIG. 10, with the second support moved from a position adjacent to the first working end to another position adjacent to a second working end of the first support and pivoted about one of the pins.
Figure 12:
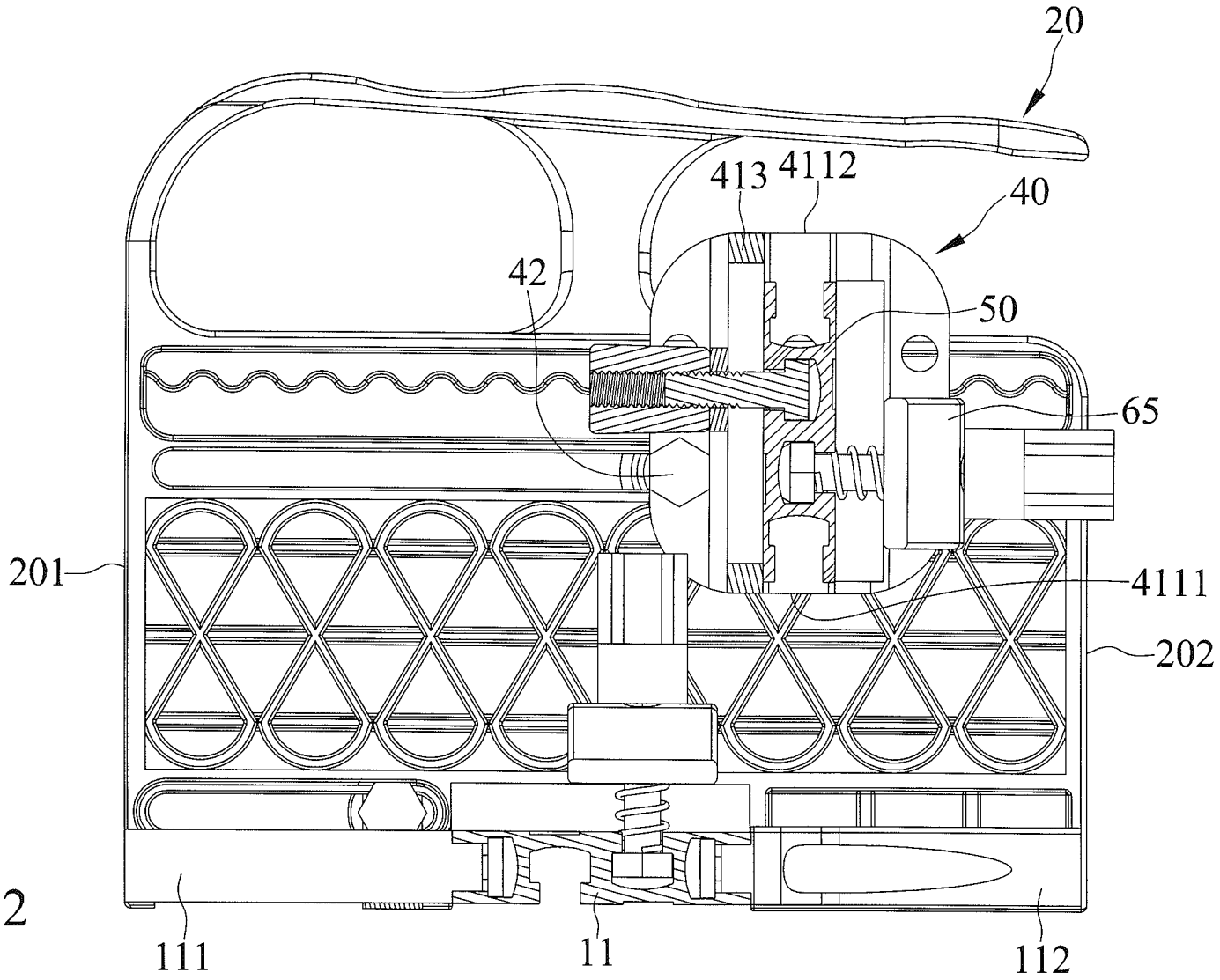
FIG. 12 is a diagrammatic view similar to FIG. 11, with the second support pivoted about one of the pins to displace an abutting face from a location adjacent to a first end of a first sidewall to another location adjacent to the second end of the first sidewall.
Figure 13:
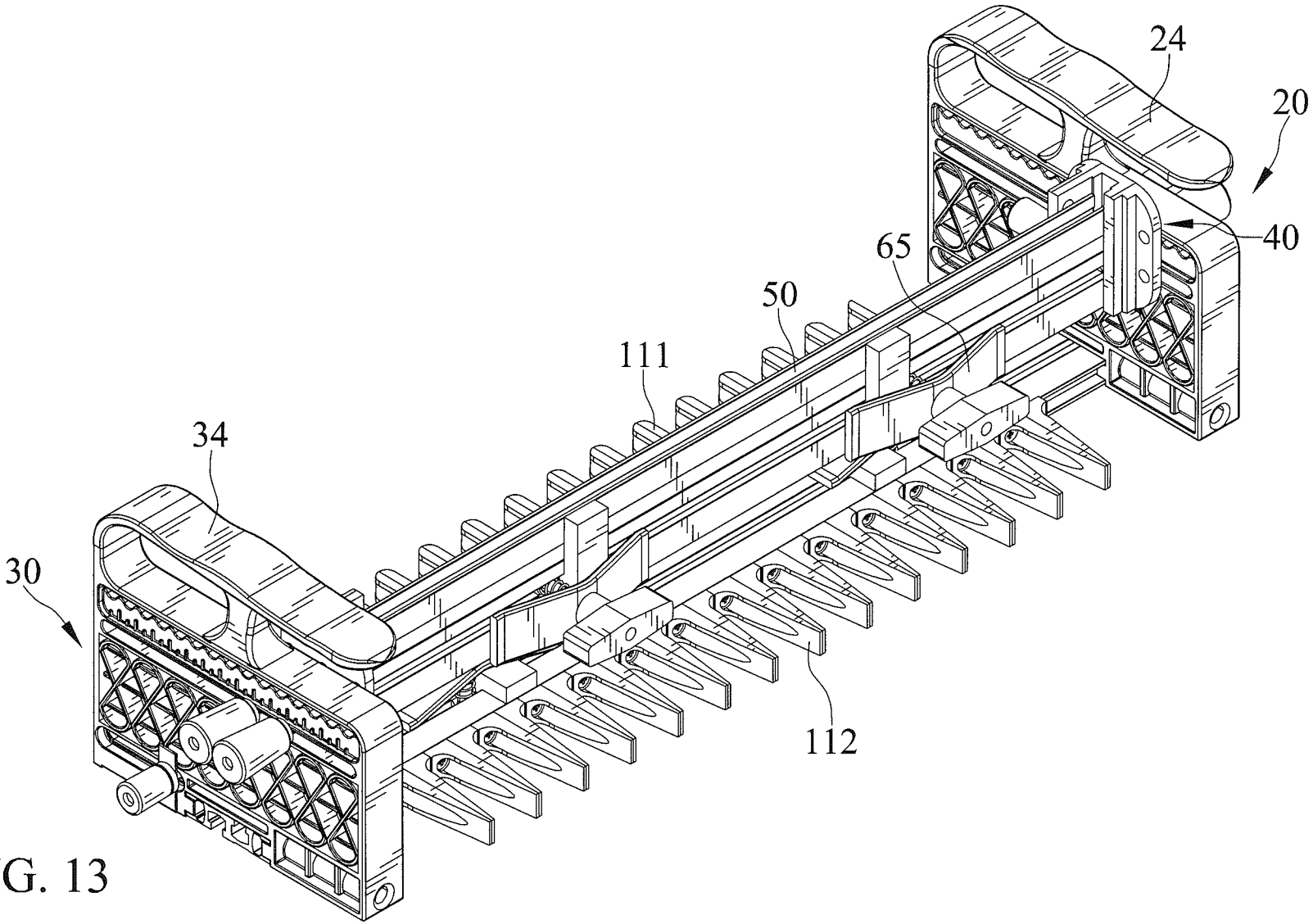
FIG. 13 is a perspective view of the handheld mortise forming device according to the present invention with the second support located adjacent to the second working end of the first support.

With reference to FIGS. 2 and 9, when it is desired to cut a mortise with a special angle in the lumber, one of the two pins 42 firstly extends through the through-hole 412 (which is located between the first and second extensions 413 and 414 and which is adjacent to a side of the first surface 4111 of the base portion 411) and extends through the first sliding track 22 of the first sidewall 20. Then, the other pin 42 extends through the through-hole 412 (which is located on a side of the second extension 414 distant to the first extension 413 and which is adjacent to a side of the second surface 4112 of the base portion 411) and extends through the first sliding track 22 of the first sidewall 20. Next, the first and second nuts 44 and 45 are respectively and threadedly engaged with the threads 421 of the two pins 42, such that the third axis L3 is spaced from the second axis L2 by an angle D. In this embodiment, the angle D is 45°. Operations of the two connecting units 40 are identical. Thus, only the connecting unit 40 adjacent to the first sidewall 20 is set forth.

With reference to FIGS. 1, 2, and 10-13, the first and second working ends 111 and 112 permit cutting of mortises of various shapes. When it is desired to change the shape of the mortise, the second support 50 is moved from the first working end 111 to the second working end 112. One of the two pins 42 firstly extends through the through-hole 412 (which is located between the first and second extensions 413 and 414 and which is adjacent to a side of the first surface 4111 of the base portion 411) and extends through the first sliding track 22 of the first sidewall 20. The first nut 44 is threadedly engaged with the pin 42, such that the user can push the second support 50 to slide the pin 42 toward the second working end 112 along the first sliding track 22. Furthermore, the second support 50 rotates about the pin 42, such that the abutting face 53 of the second support 50 moves from a position adjacent to the first end 201 of the first sidewall 20 to a position adjacent to the second end 202 of the first sidewall 20. Furthermore, the first surface 4111 of the base portion 411 moves from a position in which the connecting unit 40 is distant to a side of the first support 11 to another position in which the connecting unit 40 is adjacent to the first support 11. Then, the other pin 42 extends through the through-hole 412 (which is located on a side of the first extension 413 distant to the second extension 414 and which is adjacent to a side of the first surface 4111 of the base portion 411) and extends through the first sliding track 22 of the first sidewall 20, such that the second support 50 is perpendicular to the first support 11. Operations of the two connecting units 40 are identical. Thus, only the connecting unit 40 adjacent to the first sidewall 20 is set forth.

Conclusively, the first and second working ends 111 and 112 permit cutting of mortises of various shapes, such that the user can switch the pressing member 65 between the first and second working ends 111 and 112 according to the design need. When the pressing member 65 is adjacent to the first working end 111, the lumber clamped by the second support 50 and the pressing member 65 can be cut to form dovetail grooves. When the pressing member 65 is adjacent to the second working end 112, the lumber clamped by the second support 50 and the pressing member 65 can be cut to form vertical grooves.

Furthermore, when it is desired to move the second support 50 upward or downward relative to the first support 11, the third nut 46 is loosened first and is rotated relative to the thread 431 of the fixing member 43 in a direction away from the first extension 413. The fixing member 43 is slideable relative to the sliding slot 4131 of the sliding member 41. Then, the user moves the second support 50 to a desired height. Finally, the third nut 46 is rotated in a direction toward the first extension 413. The second support 50 and the third nut 46 together clamp the first extension 413 to thereby position the second support 50 in the desired height. Thus, the user can press the second support 50 against the lumber and position the second support 50 in the desired height according to the thickness of the lumber clamped between the first support 11 and the clamping member 61.

Furthermore, when it is desired to cut a mortise with a special angle in the lumber, one of the two pins 42 firstly extends through the through-hole 412 (which is located between the first and second extensions 413 and 414 and which is adjacent to a side of the first surface 4111 of the base portion 411) and extends through the first sliding track 22 of the first sidewall 20. Then, the other pin 42 extends through the through-hole 412 (which is located on a side of the second extension 414 distant to the first extension 413 and which is adjacent to a side of the second surface 4112 of the base portion 411) and extends through the first sliding track 22 of the first sidewall 20. Next, the first and second nuts 44 and 45 are respectively and threadedly engaged with the threads 421 of the two pins 42, such that the third axis L3 is spaced from the second axis L2 by an angle D of 45°. Thus, the user can cut a mortise having 45° in the lumber clamped by the second support 50.

Although specific embodiments have been illustrated and described, numerous modifications and variations are still possible without departing from the scope of the invention. The scope of the invention is limited by the accompanying claims.

The invention claimed is:

1. A handheld mortise forming device comprising:

a base unit including a first support extending parallel to a first axis and including a first working end and a second working end opposite to the first working end;

a first sidewall connected to the first support, with the first sidewall having a first end and a second end opposite to the first end;

a second sidewall connected to the first support;

two connecting units, with one of the two connecting units rotatably mounted to the first sidewall, with another of the two connecting units rotatably mounted to the second sidewall;

a second support extending parallel to the first axis and connected to the two connecting units, with the second support rotatable relative to the first and second sidewalls and including an abutting face movable between a position adjacent to the first end of the first sidewall and another position adjacent to the second end of the first sidewall.; and a clamping unit including a pressing member located on a side of the second support adjacent to the abutting face, with the pressing member adapted to clamp lumber, with the pressing member jointly rotatable with the second support and switchable between the first working end and the second working end, with the first and second working ends located on two opposite ends of the first support along a second axis perpendicular to the first axis, with the first sidewall including a first sliding track extending parallel to the second axis, with the second sidewall including a second sliding track extending parallel to the first sliding track, with one of the two connecting units rotatably and slideably received in the first sliding track, with another of the two connecting units rotatably and slideably received in the second sliding track, with the second support slideably connected to the two connecting units to thereby move toward or away from the first support, with the second support slideable between the first working end and the second working end, with the clamping unit further including a clamping member disposed between the first and second working ends of the first support, and with the clamping member adapted to clamp the lumber, with the first sliding track extending through two opposite surfaces of the first sidewall, with the second sliding track extending through two opposite surfaces of the second sidewall, with each of the two connecting units including a sliding member and at least one pin, with the sliding member including a base portion and at least one through-hole extending through the base portion, with the base portion of one of the two connecting units located on a side of the sliding member adjacent to the first sidewall, with the base portion of the other of the two connecting units located on a side of the sliding member adjacent to the second sidewall, with the at least one pin of one of the two connecting units removably extending through the first sliding track and removably extending through the at least one through-hole of one of the two connecting units, with the at least one pin of another of the two connecting units removably extending through the second sliding track and removably extending through the at least one through-hole of another of the two connecting units, and with each sliding member including a first extension disposed on the base portion thereof and extending toward the second support, with the first extension including a sliding slot extending through two opposite surfaces of the first extension and extending parallel to the base portion, with the second support including a fixing groove in a face thereof opposite to the abutting face, with each of the two connecting units including a fixing member removably mounted in the fixing groove of the second support and removably and slideably extending through the sliding slot of one of the sliding members.

2. The handheld mortise forming device as claimed in claim 1, with each sliding member including a second extension connected to the base portion and extending parallel to the first extension, with the second support slideably extending between the first and second extensions of each sliding member, with the at least one through-hole of each of the two connecting units including six through-holes, with two of the six through-holes located on a side of the first extension distant to the second extension, with another two of the six through-holes located between the first and second extensions, with the remaining two through-holes located on a side of the second extension distant to the first extension, and with the at least one pin of each of the two connecting units including two pins respectively extending two of the six through-holes.

3. The handheld mortise forming device as claimed in claim 2, with each of the two pins of each of the two connecting units including a thread, with the threads of the two pins of one of the two connecting units located on a side of the first sidewall distant to the second support, with the threads of the two pins of another of the two connecting units located on a side of the second sidewall distant to the second support, with the fixing member of each of the two connecting units including a thread located on a side of the first extension distant to the second support, with each of the two connecting units further including a first nut, a second nut, and a third nut, with the first and second nuts threadedly engaged with the threads of the two pins, and with the third nut threadedly engaged with the thread of the fixing member.

4. The handheld mortise forming device as claimed in claim 1, with the first support including a first groove between the first and second working ends, with the second support including a second groove on a side of the second support adjacent to the abutting face, with the clamping unit including a first bolt, a first thumb turn, a first pressing block, a second bolt, a second thumb turn, and a second pressing block, with the first bolt and the first pressing block slideably received in the first groove, with the first bolt extending through the clamping member, with the first thumb turn threadedly engaged with the first bolt and pressing against the clamping member to clamp the lumber, with the first pressing block pressing against the lumber, with the second bolt and the second pressing block slideably received in the second groove, with the second bolt extending through the pressing member, with the second thumb turn threadedly engaged with the second bolt and pressing against the pressing member to clamp the lumber, and with the second pressing block pressing against the lumber.

5. The handheld mortise forming device as claimed in claim 4, with the first sidewall including a first gripping portion and a first connecting end, with the first sliding track located between the first gripping portion and the first connecting end, with the second sidewall including a second gripping portion and a second connecting end, with the second sliding track located between the second gripping portion and the second connecting end, and with the first and second gripping portions adapted to be gripped by a user.

6. The handheld mortise forming device as claimed in claim 4, with the first sidewall further including a first sliding slot adjacent to the first working end of the first support, with the second sidewall including a second sliding slot adjacent to the first working end of the first support, with the base unit including an abutting member, a first screw, a second screw, a first fastener, and a second fastener, with the abutting member extending toward the first and second sidewalls and located on a side of the first working end distant to the second support, with the first screw extending through the abutting member and slideably received in the first sliding slot of the first sidewall, with the second screw extending through the abutting member and slideably received in the second sliding slot of the second sidewall, with the first fastener threadedly engaged with the first screw, with the second fastener threadedly engaged with the second screw, and with the abutting member positioned relative to the first working end.

* * * * *